US007722015B2

(12) United States Patent
Koizumi

(10) Patent No.: US 7,722,015 B2
(45) Date of Patent: May 25, 2010

(54) INTERNAL SHAPE OF ROTOR FOR TWO-BORE ROTARY CARBURETOR USED IN STRATIFIED SCAVENGING ENGINE

(75) Inventor: Kimio Koizumi, Isehara (JP)

(73) Assignee: Zama Japan Kabushiki Kaisha (JP)

( * ) Notice: Subject to any disclaimer, the term of this patent is extended or adjusted under 35 U.S.C. 154(b) by 335 days.

(21) Appl. No.: 11/954,548

(22) Filed: Dec. 12, 2007

(65) Prior Publication Data

US 2009/0072417 A1 Mar. 19, 2009

(30) Foreign Application Priority Data

Dec. 27, 2006 (JP) ..... 2006-350760

(51) Int. Cl.
*F02M 7/24* (2006.01)
*F02M 9/08* (2006.01)

(52) U.S. Cl. ..... 261/23.3; 123/73 PP; 261/44.8; 261/DIG. 1

(58) Field of Classification Search ..... 261/23.2, 261/23.3, 44.6, 44.8, 45, 54, 63, DIG. 1; 123/73 PP
See application file for complete search history.

(56) References Cited

U.S. PATENT DOCUMENTS 4,526,729 A * 7/1985 Braun et al. ..... 261/36.2
5,709,822 A * 1/1998 Togashi ..... 261/44.2
6,418,891 B2 * 7/2002 Kobayashi ..... 123/73 PP
6,585,235 B2 * 7/2003 Pattullo ..... 261/44.8
7,104,252 B1 * 9/2006 Pattullo ..... 123/311
7,261,281 B2 * 8/2007 Raffenberg ..... 261/44.8
7,267,327 B2 * 9/2007 Sasaki et al. ..... 261/44.6
7,325,791 B2 * 2/2008 Koizumi ..... 261/44.8
2001/0020454 A1 * 9/2001 Kobayashi ..... 123/73 A
2004/0025817 A1 * 2/2004 Uenoyama et al. ..... 123/73 A
2005/0104235 A1 * 5/2005 Sasaki et al. ..... 261/44.6

FOREIGN PATENT DOCUMENTS

DE 3246163 A1 * 6/1983 ..... 261/44.8
JP 10252565 (A) 9/1998

* cited by examiner

*Primary Examiner*—Richard L Chiesa
(74) *Attorney, Agent, or Firm*—Orrick, Herrington & Sutcliffe LLP

(57) ABSTRACT

The present invention provides an internal shape of a rotor for a two-bore rotary carburetor used in a stratified scavenging engine whereby an engine for a power saw, lawn mower, or the like can be stabilized in the course of a complete change in orientation during idling. A groove pocket (10) in communication with a fuel supply-side bore (8) is formed at the aperture edge of each of the upstream end and the downstream end of a carburetor rotor valve (6) toward an accelerated rotation direction in the fuel supply-side bore (8) of the rotor valve (6). The groove pocket (10) is shaped so as to gradually rise and decrease in cross-sectional surface area toward the accelerated rotation direction along a peripheral surface of the rotor valve (6). The resulting structure is one in which the groove pocket (10) is initially superposed with the mixing channel during horizontal rotation of the rotor valve (6), the fuel supply-side bore (8) and the mixing channel are in communication with each other, and the fuel supply-side bore (8) opens before the air supply-side bore (7) does.

5 Claims, 8 Drawing Sheets

INTERNAL SHAPE OF ROTOR FOR TWO-BORE ROTARY CARBURETOR USED IN STRATIFIED SCAVENGING ENGINE

BACKGROUND OF THE INVENTION

1. Field of the Invention

The present invention relates to an internal shape of a rotor for a two-bore rotary carburetor used in a stratified scavenging engine applicable to a two-stroke internal combustion engine for a power saw, lawn mower, or the like.

2. Description of the Related Art

There are conventionally known carburetors for a two-cycle engine in which the terminal end of an air channel is connected to a portion adjacent to the scavenging port of a scavenging channel for connecting the scavenging port and the crankcase of the engine. The air channel is provided with a check valve for allowing air to flow to the scavenging channel. The starting end of the air channel is connected to the inlet portion of an air intake conduit. The air channel is provided with an air control valve for varying the amount of air; and the air control valve for varying the amount of air in the air channel is provided as an integrated structure together with a fuel control valve for varying the amount of fuel in an air intake channel to the air intake channel and the air channel disposed in parallel to the carburetor main body so that the valves can rotate about an axis that traverses the two channels (see JP-A 10-252565).

In the prior-art carburetor, the same single rotor has two bores shaped as circular orifices, and the bore on the side of the fuel supply opens first during idling. To achieve this, a two-step rotor structure is adopted so that the outside diameter of the rotor is greater in the bore on the side of the air supply. The carburetor of an air-leading stratified scavenging two-cycle engine has a simple structure in which a partition is placed into the same bore, and has the merit of being able to be made more compact and allowing the engine to be designed to smaller dimensions because the height of the carburetor can be minimized. However, it is difficult to maintain a lean air-fuel ratio at idling by merely installing a partition in the same bore because the structural features of the rotor carburetor designed to aid in controlling the air-fuel ratio cause the rotor to be displaced downward at the throttle opening maintained during idling, and result in an arrangement in which the bore on the side of the air supply opens first, and the bore on the side of the fuel supply opens second.

The bore on the side of the fuel supply can be made to open first during idling if the shape of the bore on the side of the fuel supply is made symmetrically larger, but because the air-fuel ratio varies greatly when the bore on the side of the air supply starts to open in a partial state, it is difficult to control the fuel so that an optimal air-fuel ratio is obtained.

SUMMARY OF THE INVENTION

An object of the present invention is to provide an internal shape of a rotor for a two-bore rotary carburetor used in a stratified scavenging engine whereby an engine for a power saw, lawn mower, or the like can be stabilized in the course of a complete change in orientation during idling.

In a two-bore rotary carburetor used in a stratified scavenging engine according to the present invention, a carburetor main body is provided with a rotor valve fitted into a vertically formed, bottomed cylindrical rotor valve port. The rotor valve is a single cylinder having substantially the same diameter as the rotor valve port. An air supply-side bore and a fuel supply-side bore are formed through the rotor valve so as to traverse the rotor valve in a radial direction, wherein a minimal groove pocket is formed at the aperture edge of each of the downstream end and upstream end of the rotor valve on the side located in the accelerated rotation direction in the fuel supply-side bore.

A two-bore rotary carburetor used in a stratified scavenging engine according to the present invention is provided with a rotor valve fitted into a vertically formed, bottomed cylindrical rotor valve port. The rotor valve is a single cylinder having substantially the same diameter as the rotor valve port. An air supply-side bore and a fuel supply-side bore are formed so as to traverse the rotor valve in a radial direction. The fuel supply-side bore has a cross-sectional shape that is semicircular and is directed downward. The air supply-side bore has a cross-sectional shape that is semicircular and is directed upward, and has an aperture surface area that is greater than that of the fuel supply-side bore immediately above the fuel supply-side bore. A partition is placed between the fuel supply-side bore and the air supply-side bore, wherein a minimal groove pocket is formed at the aperture edge of each of the downstream end and upstream end of the rotor valve on the side located in the accelerated rotation direction in the fuel supply-side bore.

Each of the groove pockets is formed at the aperture edge symmetrically relative to a center axis and has a shape that gradually rises and decreases in cross-sectional surface area toward an accelerated rotation direction along a peripheral surface of the rotor valve.

In a two-bore rotary carburetor used in a stratified scavenging engine according to the present invention, a carburetor main body is provided with a rotor valve fitted into a vertically formed, bottomed cylindrical rotor valve port. The rotor valve is a single cylinder having substantially the same diameter as the rotor valve port. An air supply-side bore having a circular shape in cross section and a fuel supply-side bore having a circular shape in cross section are formed through the rotor valve so as to traverse the rotor valve in parallel in a radial direction, wherein a minimal groove pocket is formed at the aperture edge of each of the downstream end and upstream end of the rotor valve on the side located in the accelerated rotation direction in the fuel supply-side bore.

Each of the groove pockets is formed at the aperture edge symmetrically relative to a center axis and has a shape that gradually rises and decreases in cross-sectional surface area toward an accelerated rotation direction along a peripheral surface of the rotor valve.

In a two-bore rotary carburetor used in a stratified scavenging engine according to the present invention, a minimal groove pocket is formed at the aperture edge of each of the downstream end and upstream end of the rotor valve on the side located in the accelerated rotation direction in the fuel supply-side bore. Therefore, operation at the groove pocket of the fuel supply-side bore can be carried out in the period from idling to the throttle opening maintained during idling, and all the air and fuel can be fed to the engine via the groove pocket. Accordingly, an emulsion can be formed relatively rapidly and fed to the engine, making it possible to reduce the drop in rotation in the course of a complete change in orientation during idling.

In a two-bore rotary carburetor used in a stratified scavenging engine according to the present invention, each of the groove pockets is formed at the aperture edge symmetrically relative to a center axis and has a shape that gradually rises and decreases in cross-sectional surface area toward an accelerated rotation direction along a peripheral surface of the rotor valve. Therefore, it is possible to reduce the variation in the amount of air when the air supply-side bore starts to open in the period from idling to a partial state, making it easier to control the air-fuel ratio at a partial throttle opening. (Variation in CO % can be minimized.)

In a two-bore rotary carburetor used in a stratified scavenging engine according to the present invention, concavities of the groove pockets in the fuel supply-side bore are disposed toward the upstream and downstream sides of the nozzle part in the center, and the expansion and contraction of air during a fully opened state do not reach the nozzle part. Therefore, stability of the air-fuel ratio in a fully opened state is not compromised, and the fuel can be stably controlled.

DESCRIPTION OF THE PREFERRED EMBODIMENTS

An example of an internal shape of a rotor for a two-bore rotary carburetor used in a stratified scavenging engine according to the present invention is described below with reference to the accompanying drawings.

Figure 1:
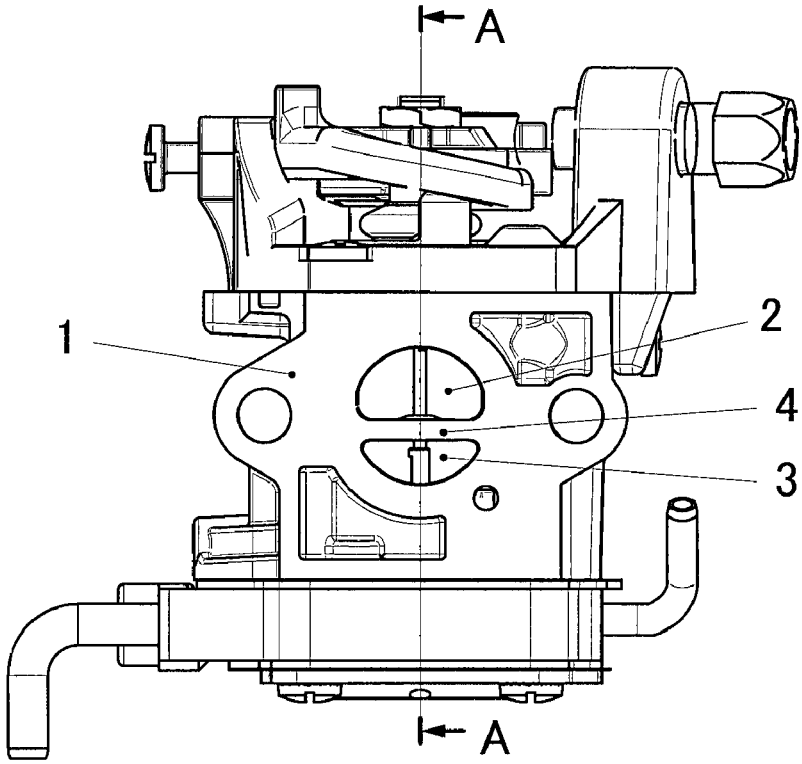
FIG. 1 is a front view of a carburetor according to an example of the present invention.

FIG. 1 is a front view of an example of a two-bore rotary carburetor for a stratified scavenging engine according to the present invention. In the drawing, 1 is the carburetor main body, 2 is an air channel formed through the carburetor main body 1, 3 is a mixing channel formed through the carburetor main body 1, and 4 is a partition formed in the carburetor main body 1 and used to separate the air channel 2 and the mixing channel 3.

Figure 2:
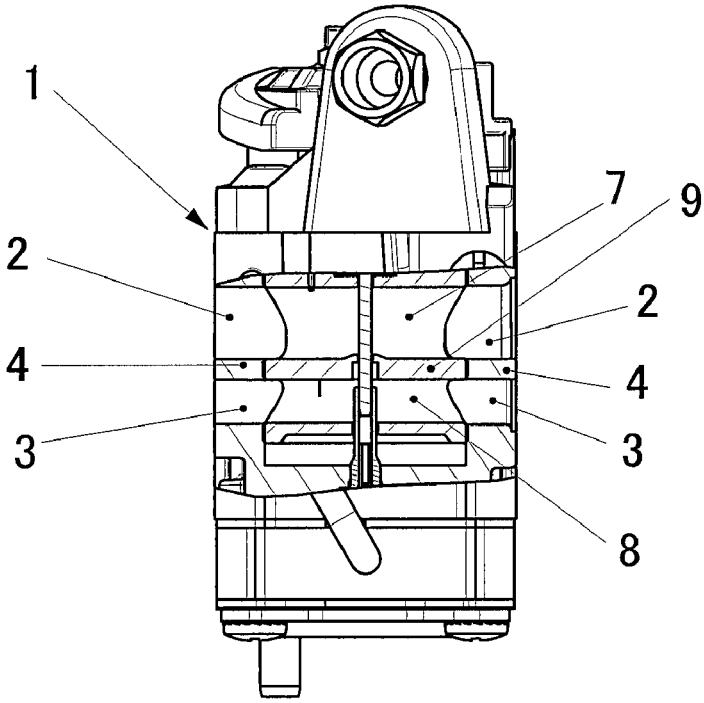
FIG. 2 is a cross-sectional view along A-A in FIG. 1.

As shown in FIG. 2, which is a cross section obtained by cutting FIG. 1 along line A-A, the mixing channel 3 is disposed underneath the air channel 2 in the carburetor main body 1; i.e., the channels are disposed one above the other so that when a the carburetor main body is cross-cut in a horizontal direction, the air channel 2 has an ascending semicircular shape and the mixing channel 3 has an descending semicircular shape in the resulting cross section. The channels are formed into a single common cylindrical circular orifice in which the two are separated from each other by the partition 4.

The left-hand ends (in FIG. 2) of the air channel 2 and the mixing channel 3 are connected to an upstream air cleaner, and the right-hand ends (in FIG. 2) of the air channel 2 and the mixing channel 3 are connected to an air intake channel and a scavenging channel via an engine-side insulator on the downstream side.

Figure 3:
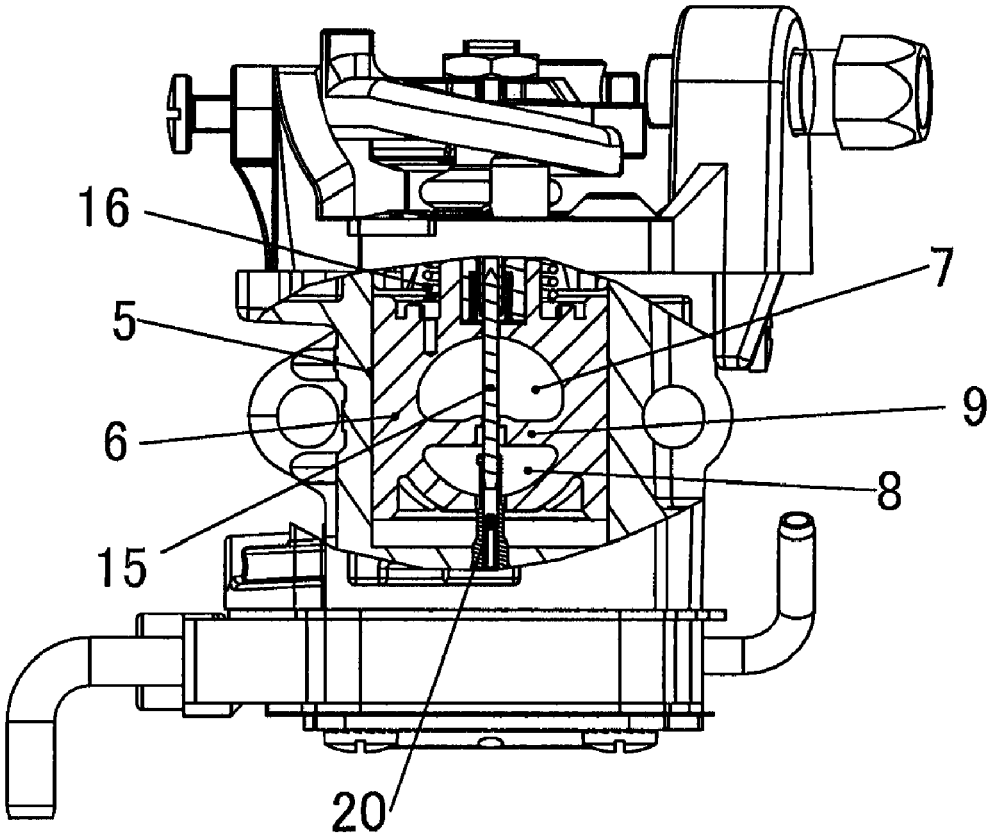
FIG. 3 is a cutaway front view of the carburetor according to an example of the present invention.

As shown in FIG. 3, which is a cutaway view of FIG. 1, the carburetor main body 1 is provided with a rotor valve 6 fitted into a vertically formed, bottomed cylindrical rotor valve port 5. The rotor valve 6 is a single cylinder having substantially the same diameter as the rotor valve port 5. An air supply-side bore 7 and a fuel supply-side bore 8 are formed through the rotor valve 6 so as to traverse the rotor valve 6 in a radial direction. The air supply-side bore 7 has an ascending semicircular shape in cross section, and the fuel supply-side bore 8 has a descending semicircular shape in cross section. The air supply-side bore 7 has a greater aperture surface area than does the fuel supply-side bore 8. A partition 9 is placed between the air supply-side bore 7 and the fuel supply-side bore 8, and a single common cylindrical circular orifice in which the two are mutually separated is formed.

It is apparent that the air supply-side bore 7 does not necessarily have to have an aperture surface area greater than that of the fuel supply-side bore 8. The air supply-side bore 7 is used to feed air to the air channel 2 in order to control the flow rate of scavenging air, and the fuel supply-side bore 8 is used to feed a fuel-air mixture to the mixing channel 3 in order to control the engine output.

The air channel 2 and mixing channel 3, as well as the air supply-side bore 7 and fuel supply-side bore 8 are formed in substantially the same cross-sectional shape, and the two pairs form a single common cylindrical circular orifice in which the two are aligned with each other by the partitions 4 and 9, respectively.

This arrangement of the common circular orifice extends across a smaller vertical distance than the arrangement described in connection with another example below in which an air channel having a circular cross section and a mixing channel having a circular cross section are arranged in parallel one above the other, and therefore contributes to reducing the size of the carburetor.

Figure 4:
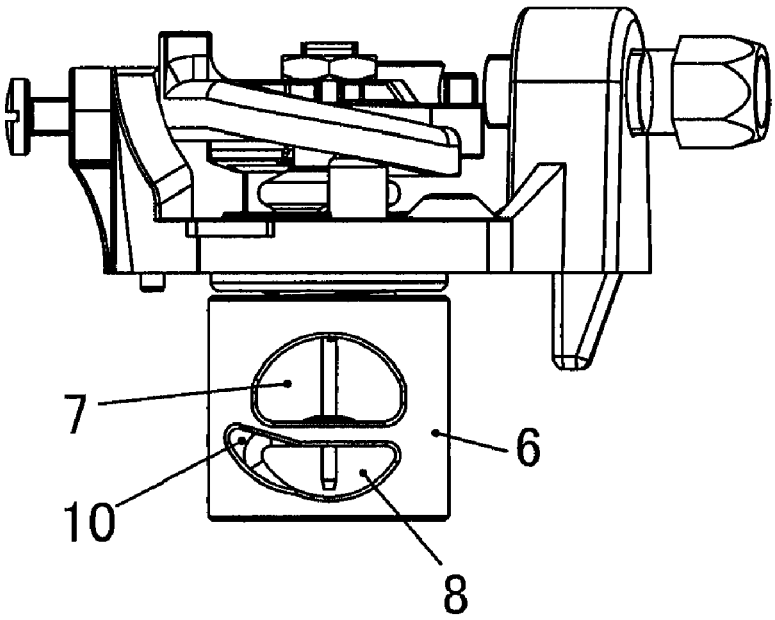
FIG. 4 is a front view of the rotor valve according to the present invention.

As can be seen in the front view of the carburetor rotor valve in FIG. 4, the fuel supply-side bore 8 is provided with a groove pocket 10 connected to the fuel supply-side bore 8 at the aperture edge of each of the downstream end and upstream end of the rotor valve 6 on the side located in the accelerated rotation direction.

Figure 5:
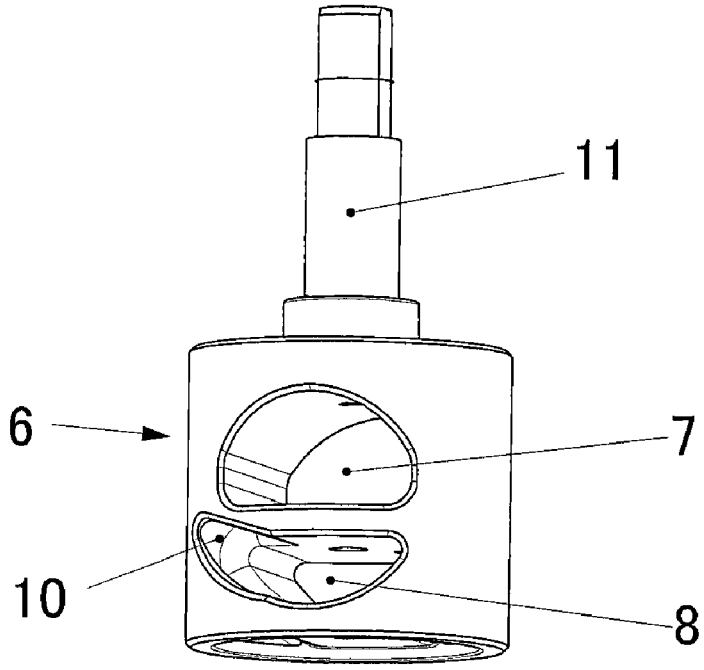
FIG. 5 is an enlarged perspective view of the rotor valve according to the present invention.

FIG. 4 shows only the groove pocket 10 at the aperture edge of the upstream end, but the groove pocket 10 at the aperture edge of the downstream end is formed symmetrically relative to a center axis. As shown in FIG. 5, the groove pocket 10 has a shape that gradually rises and decreases in cross-sectional surface area toward an accelerated rotation direction along a peripheral surface of the rotor valve 6. The resulting structure is one in which the groove pocket 10 is initially superposed with the mixing channel 3 during horizontal rotation of the rotor valve 6, the fuel supply-side bore 8 and the mixing channel 3 are in communication with each other, and the fuel supply-side bore 8 opens before the air supply-side bore 7 does.

Figure 6:
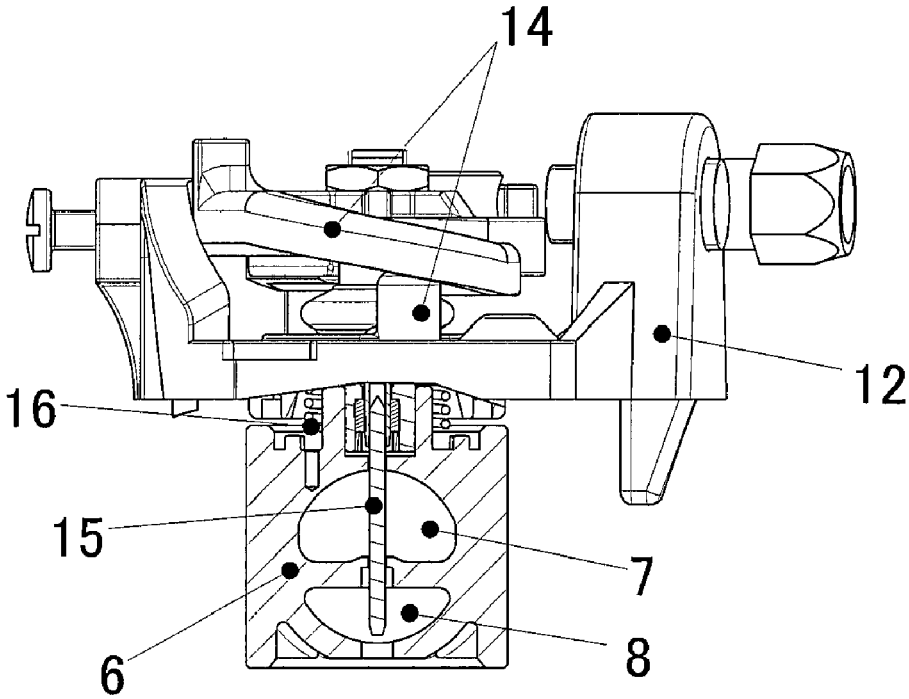
FIG. 6 is a cutaway front view of the rotor valve according to the present invention.
Figure 7:
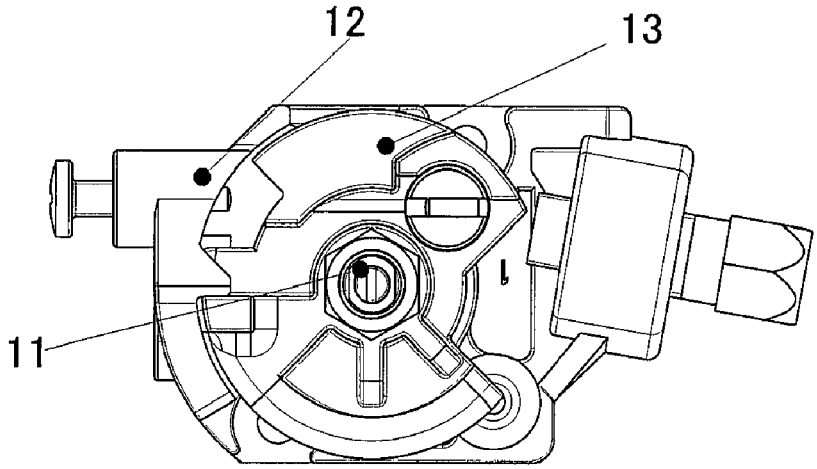
FIG. 7 is a plan view of a carburetor according to an example of the present invention.

As can be seen in the cross-sectional view of the carburetor rotor valve in FIGS. 5 and 6, the rotor valve 6 has a throttle shaft 11 that extends upward from the air supply-side bore 7 and the fuel supply-side bore 8, extends further outside the rotor valve 6, and passes through a rotor cover 12 that covers the end portion of the upward aperture in the rotor valve port 5. The throttle shaft 11 is rotatably supported by the carburetor main body 1. As can be seen in the plan view of the carburetor in FIG. 7, a throttle lever 13 is attached to the terminal end of the throttle shaft 11 that extends from the rotor cover 12.

Therefore, pulling a throttle cable wire (not shown) threadably secured in the throttle lever 13 causes the rotor valve 6 to be rotated horizontally about the throttle shaft 11 by the rotation of the throttle lever 13, and the throttle lever 13 and the rotor valve 6 are horizontally rotated by about 90° while gradually lifted up by a cam mechanism 14 disposed between the carburetor main body 1 and the throttle lever 13.

Specifically, the air supply-side bore 7 and the fuel supply-side bore 8, as well as the air channel 2 and the mixing channel 3 in the rotor valve 6 are orthogonal to each other during a stop at 0° so that the two channels 2 and 3 are closed off. Only the groove pocket 10 is connected to the mixing channel 3 during horizontal rotation at about 15° (idling). The air supply-side bore 7 and the fuel supply-side bore 8, as well as the air channel 2 and the mixing channel 3 are proportionately opened during partial horizontal rotation at about 15° to 90°. The air supply-side bore 7 and the fuel supply-side bore 8, as well as the air channel 2 and the mixing channel 3 are completely aligned in an in-line configuration during a fully opened state at 90°. The air supply-side bore 7 and the fuel supply-side bore 8 are configured to be completely partitioned from each other by the partition 9 in the period from the stop at 0° and the idling at about 15° to the fully opened state at about 90°.

As shown in FIG. 6, the rotor valve 6 has a fuel-adjusting needle 15 mounted in a downward orientation to the throttle shaft 11. The fuel-adjusting needle 15 extends from above across the air supply-side bore 7 and enters the fuel supply-side bore 8. The rotor valve 6, a throttle return spring 16 mounted on the rotor cover 12 and an end portion of the rotor valve 6 is caused to rotate horizontally while being twisted.

Figure 8:
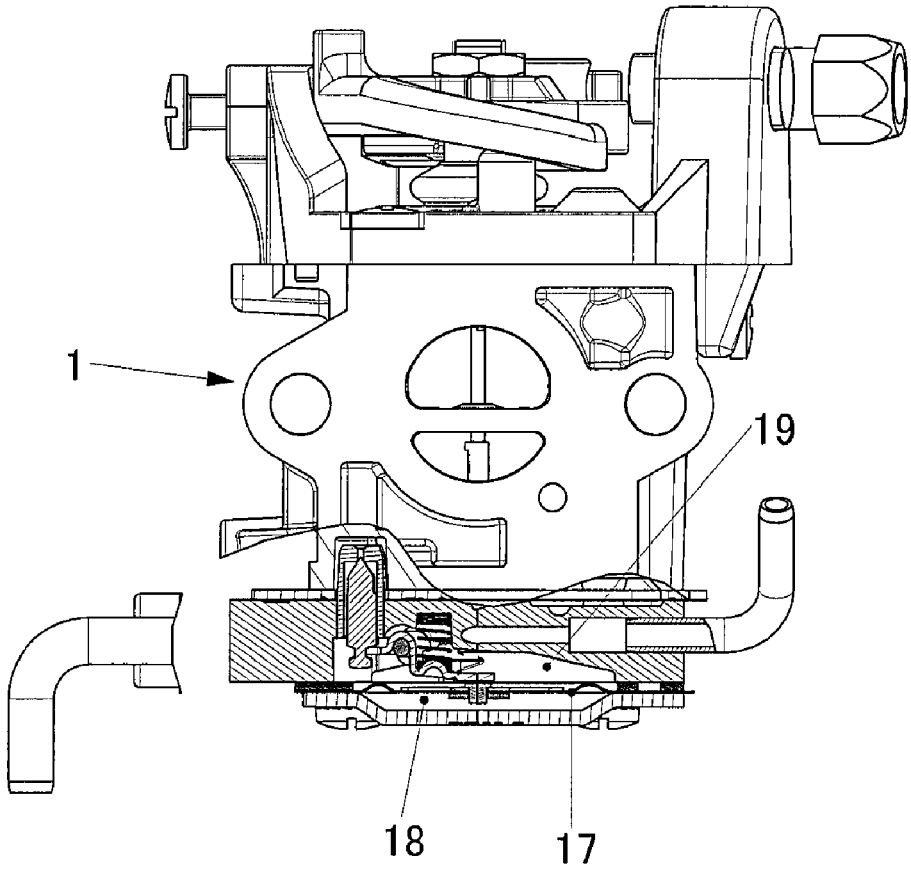
FIG. 8 is a cutaway front view of a carburetor according to an example of the present invention.

As can be seen in the cross-sectional view of the carburetor in FIG. 8, the carburetor main body 1 is provided with a metering chamber 19, which is separated by a metering diaphragm 17 from an air chamber 18 open to the atmosphere via a vent hole, in the bottom surface on the opposite side from the rotor cover 12. The fuel in the metering chamber 19 flows out of a main nozzle 20 disposed in the fuel supply-side bore 8. With the help of the cam mechanism 14, the rotor valve 6 is lifted and lowered by the horizontal rotation of the cam mechanism 14, the surface area of a hole shaped as an inverted triangle and formed in a side surface of the main nozzle 20 is varied by the fuel-adjusting needle 15 inserted into the main nozzle 20, and the fuel is controlled to modify the flow of fuel from the metering chamber 19.

Following is a description of an operation of an example of an internal shape of a rotor for a two-bore rotary carburetor used in a stratified scavenging engine according to the present invention.

In a stratified scavenging two-cycle engine, a cylinder is disposed in the upper part of a crankcase, and a piston fitted into the cylinder is reciprocatingly connected by a connecting rod to a crank arm of a crankshaft supported in a crankcase.

A spark plug that extends into a combustion chamber is mounted in the top end wall of the cylinder, the peripheral wall of the cylinder is provided with an exhaust port and a scavenging port that open near the bottom dead center of the cylinder, the scavenging port is connected to the atmosphere via an exhaust muffler, and the scavenging port is connected to a crank chamber inside the crankcase via a scavenging channel formed in the cylinder wall.

The crankcase is provided with an air intake port for connecting a terminal end of an air intake channel that aspirates an air mixture from the carburetor, and the air intake port is provided with a check valve for allowing the air mixture to flow into the crank chamber. A terminal end of an air channel for transporting air from the carburetor is connected to a portion adjacent to the scavenging port of the scavenging channel that connects the crank chamber and the combustion chamber of the cylinder, and the air channel is provided with a check valve for allowing air to flow to the scavenging channel.

The air intake channel and the air channel are connected to the atmosphere via the carburetor main body and an air filter. The air mixture formed in the carburetor is aspirated into the crank chamber via the air intake port when negative pressure is created the crank chamber during the upward movement of the piston in the engine. The air is simultaneously aspirated from the air channel into a portion adjacent to the scavenging channel or scavenging port via a stop valve. When the piston is moved downward by an explosion of the air mixture, the exhaust port near the bottom dead center of the piston opens, the air in the scavenging channel is first ejected into the cylinder by the positive pressure of the crank chamber, and the air mixture in the crank chamber is then ejected into the cylinder. In the period in which the exhaust port is open, the exhaust port remains open until the air initially ejected into the cylinder from the scavenging port flows toward the exhaust port and until the air mixture flows toward the exhaust port subsequent to the air.

When the operator rotates a throttle lever 13 via a throttle cable wire (not shown) in the accelerated rotation direction, the rotor valve 6 rotates horizontally while twisting the throttle return spring 16 attached to the rotor cover 12 and the end portion of the rotor valve 6.

Figure 9:
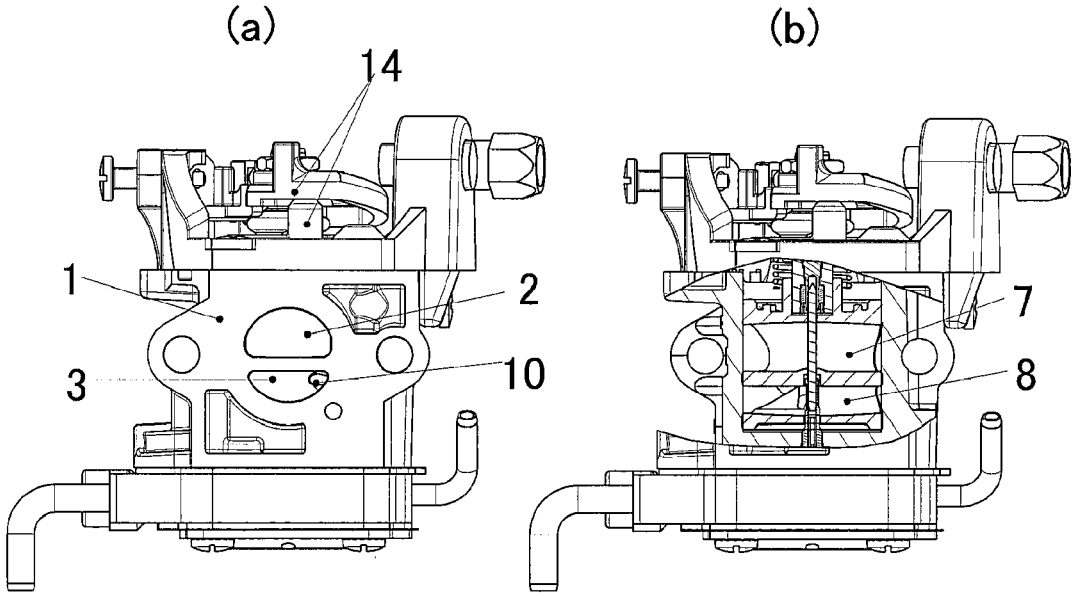
FIG. 9 is a front view (*a*) and a cutaway front view (*b*) of an idling state.

Only the groove pocket 10 is in communication with the mixing channel 3 in the period of horizontal rotation during idling at about 15°, as shown in the front view of the carburetor idling state in FIG. 9(*a*). The air supply-side bore 7 and the fuel supply-side bore 8 are disposed substantially orthogonally to the air channel 2 and the mixing channel 3 to create a closed-off condition, as shown in the cross-sectional view of the carburetor idling state in FIG. 9(*b*). The groove pocket 10 overlaps the mixing channel 3, the fuel supply-side bore 8 and the mixing channel 3 communicate with each other, and the fuel supply-side bore 8 opens before the air supply-side bore 7 does, as shown by the cross-sectional views of the air supply-side bore in FIG. 10(*a*) and the fuel supply-side bore in FIG. 10(*b*).

Figure 11:
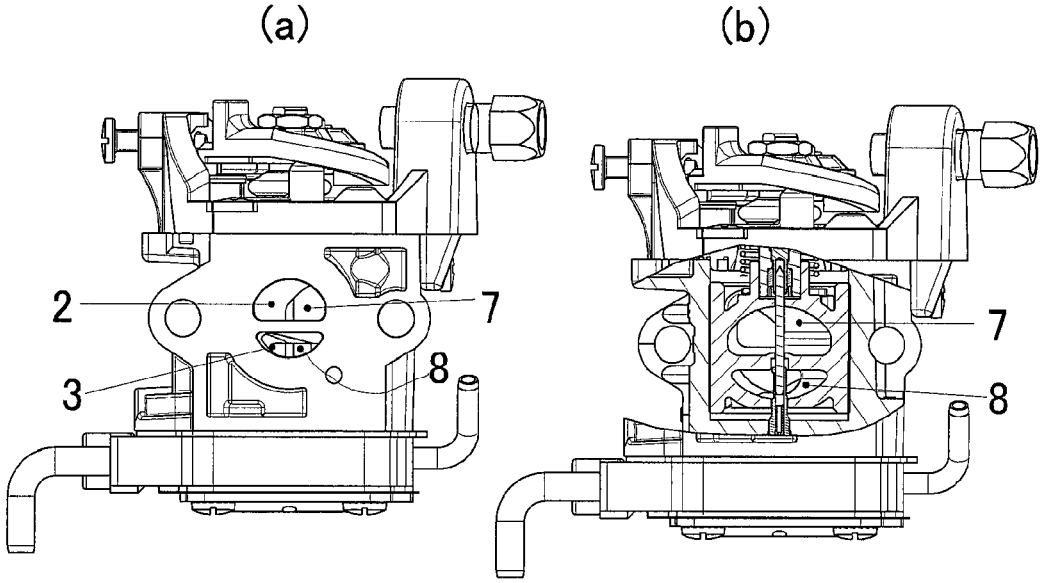
FIG. 11 is a front view (*a*) and a cutaway front view (*b*) of a partial state.

The air supply-side bore 7 and fuel supply-side bore 8, as well as the air channel 2 and the mixing channel 3 are proportionally open during partial horizontal rotation at about 15° to 90°, as shown in the front view of the partial state of the carburetor in FIG. 11(*a*). The air supply-side bore 7 and the fuel supply-side bore 8, as well as the air channel 2 and the mixing channel 3 are proportionally superposed onto each other, as shown in the cross-sectional view of the partial condition of the carburetor in FIG. 11(*b*). The amount of air and the amount of air mixture are increased by the horizontal rotation of the rotor valve 6 in accordance with the superposition angle, as shown by the cross-sectional views of the air supply-side bore in FIG. 12(*a*) and the fuel supply-side bore in FIG. 12(*b*).

At the same time, the throttle lever 13 and the rotor valve 6 are gradually lifted up by the cam mechanism 14 sandwiched between the rotor cover 12 and the throttle lever 13. Therefore, the flow rate of the fuel increases because of a reduction in the extent to which the needle 15 is inserted into the main nozzle 20.

Figure 13:
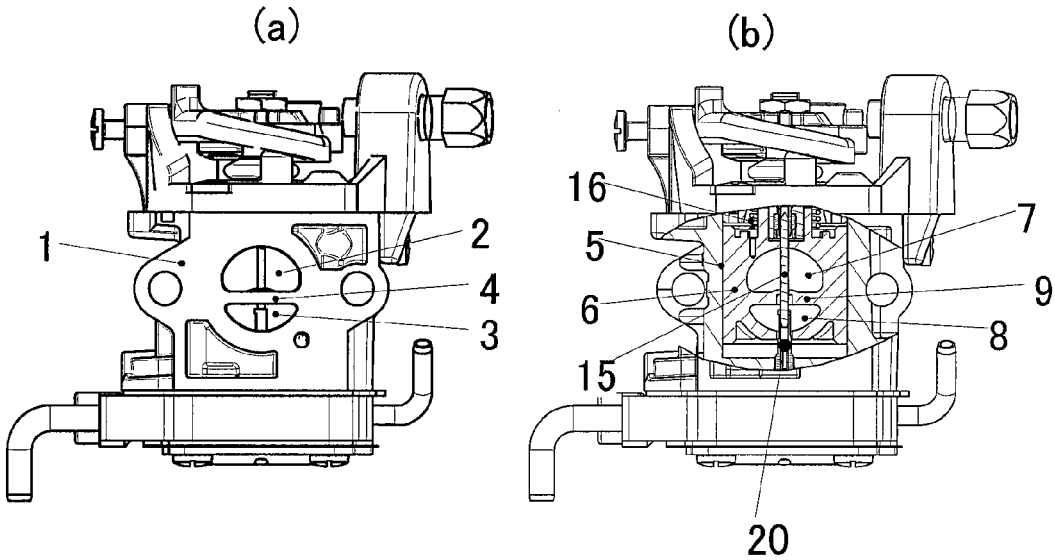
FIG. 13 is a front view (*a*) and a cutaway front view (*b*) of a fully open state.
Figure 14:
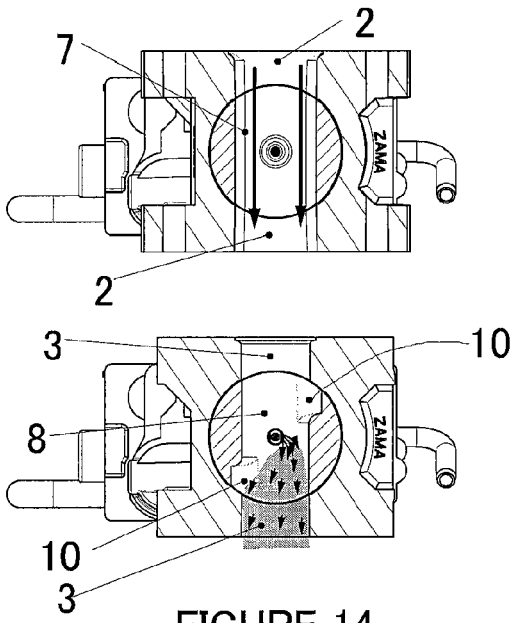
FIG. 14 is a cross-sectional view of the air supply-side bore (*a*) and a cross-sectional view of a fuel supply-side bore (*b*) of the rotor valve.

The air channel 2 and the air supply-side bore 7 are completely superposed onto each other, and the air supply-side bore 7 is completely open when the throttle lever 13 of the rotor valve 6 is completely open, as shown in the front view of the fully opened state of the carburetor in FIG. 13(*a*), the cross-sectional view of the fully opened state of the carburetor in FIG. 11(*b*), and the cross-sectional views of the air supply-side bore in FIG. 14(*a*) and the fuel supply-side bore in FIG. 14(*b*).

At the same time, the fuel supply-side bore 8 and the mixing channel 3 are completely superposed onto each other, and the fuel supply-side bore 8 is fully opened.

Also, the partition 9 formed between the air supply-side bore 7 and the fuel supply-side bore 8 formed in the rotor valve 6 lines up airtightly with the partition 4 formed between the air channel 2 and mixing channel 3 formed in the carburetor main body 1, as shown in FIG. 2.

The air channel 2 and the mixing channel 3 are formed so as to superpose on the air supply-side bore 7 and fuel supply-side bore 8 of the rotor valve 6 rotated from the state of idling at an orifice angle of 15° to a fully opened state at which the angle of the throttle lever is 90°.

Figure 12:
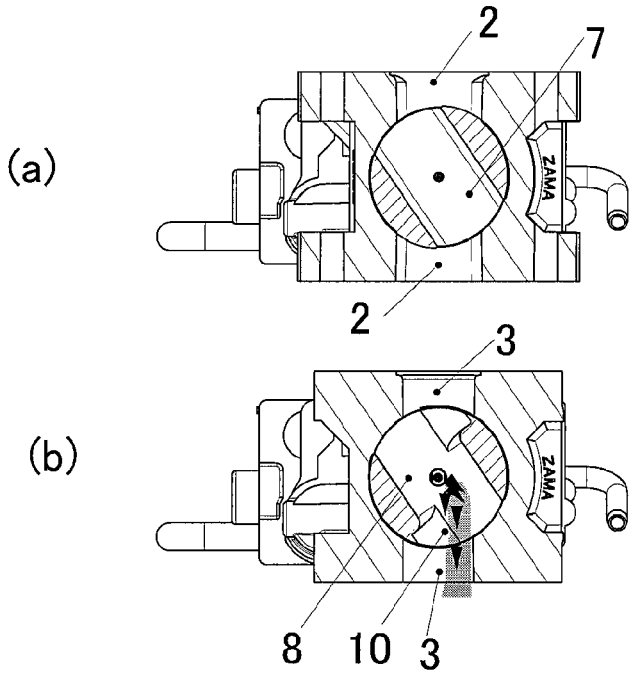
FIG. 12 is a cross-sectional view of the air supply-side bore (*a*) and a cross-sectional view of the fuel supply-side bore (*b*) of the rotor valve.

Also, the air channel 2 and the air supply-side bore 7 are partially superposed onto each other at an angle of partial opening when the fuel supply-side bore 8 and the mixing channel 3 are partially superposed onto each other at an angle at which the rotor valve 6 is partially open, as shown in FIG. 12.

Figure 10:
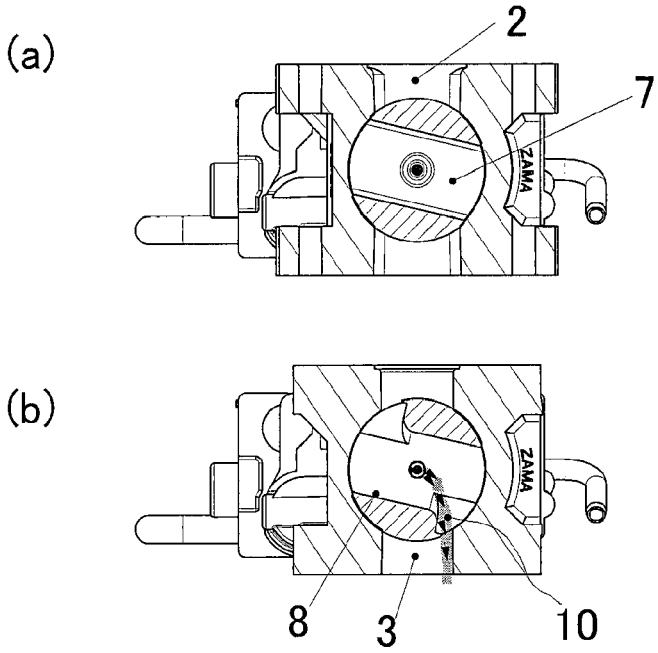
FIG. 10 is a cross-sectional view of the air supply-side bore (*a*) and the fuel supply-side bore (*b*) of the rotor valve.

Furthermore, there is a preceding partial overlap of the mixing channel 3 with the groove pocket 10 in the rotor valve 6, i.e., the groove pocket 10 of the fuel supply-side bore 8 reaches a communicating state first, when the rotor valve 6 is in an idling state, whereby the mixing channel 3 is open but the air channel 2 remains closed, as shown in FIGS. 9 and 10. Therefore, all the air and fuel are fed to the engine via the groove pocket 10, causing an emulsion to be formed relatively rapidly and to be fed to the engine. Accordingly, the drop in rotation in the course of a complete change in orientation during idling can be reduced.

The groove pocket 10 is formed symmetrically at the aperture edge and has a shape that gradually rises and decreases in cross section toward an accelerated rotation direction along the peripheral surface of the rotor valve 6. Therefore, it is possible to reduce the variation in the amount of air when the air supply-side bore 7 starts to open in the period from an idling state to a partial state, making it easier to control the air-fuel ratio in a partially opened state. (Variation in CO % can be minimized.)

Concavities of the groove pocket 10 in the fuel supply-side bore 8 are disposed toward the upstream and downstream sides of the main nozzle 20 in the center, and the expansion and contraction of air during a fully opened state do not reach the main nozzle 20. Therefore, the stability of the air-fuel ratio during a fully opened state is not compromised, and the fuel can be stably controlled.

Another example of an internal shape of a rotor for a two-bore rotary carburetor used in a stratified scavenging engine according to the present invention will now be described based on the accompanying drawings.

Figure 15:
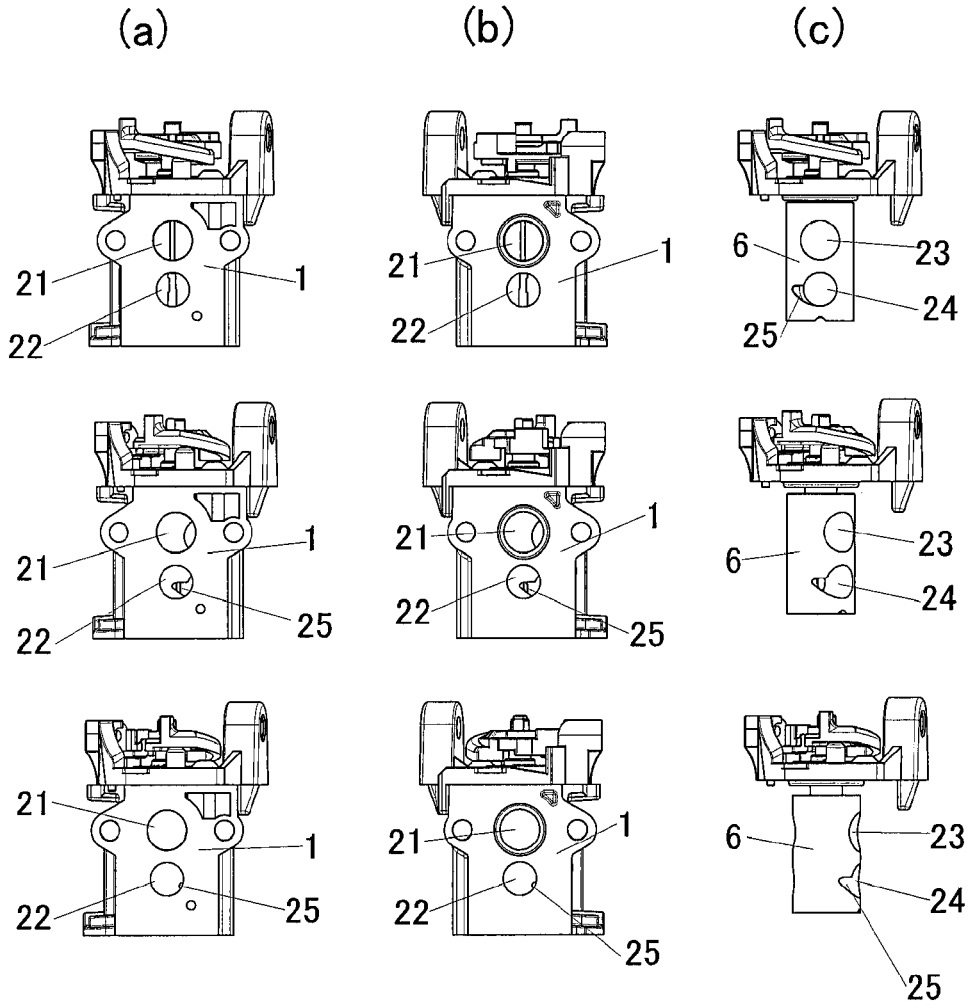
FIG. 15 is a front view (*a*), back view (*b*), and front view of the rotor valve (c) in the carburetor according to another example of the present invention.

The structure is the same as that of the above-described carburetor except that an air channel 21, a mixing channel 22, an air supply-side bore 23, and a fuel supply-side bore 24 have circular cross sections, as can be seen in the front view of the flange surface on the engine side in FIG. 15(*a*), the back view of the flange surface on the choke side in FIG. 15(*b*), and the front view of the rotor valve in FIG. 15(*c*).

The rotor valve 6 provided to the carburetor main body 1 is a single cylinder. The air supply-side bore 23 having a circular shape in cross section and the fuel supply-side bore 24 having a circular shape in cross section are formed through the rotor valve 6 so as to traverse the valve in a radial direction in a vertically parallel arrangement. The air supply-side bore 21 has a greater aperture surface area than does the fuel supply-side bore 22. The air supply-side bore 23 has a greater aperture surface area than does the fuel supply-side bore 24.

A minimal groove pocket 25 is formed in the fuel supply-side bore 24 at the aperture edge of each of the upstream end and the downstream end of the rotor valve 6 toward the accelerated rotation direction, and the groove pocket 25 is formed symmetrically relative to a center axis and has a shape that gradually rises and decreases in cross-sectional surface area toward the accelerated rotation direction along a peripheral surface of the rotor valve 6.

The operation of the other example of an internal shape of a rotor for a two-bore rotary carburetor used in a stratified scavenging engine according to the present invention is described below on the basis of the accompanying drawings.

Only the groove pocket 25 is in communication with the mixing channel 22 in the period of horizontal rotation during idling at about 15°, the groove pocket 25 overlaps the mixing channel 22, the fuel supply-side bore 24 and the mixing channel 22 are in communication, and the fuel supply-side bore 24 opens before the air supply-side bore 23 does, as can be seen in the front view of the idling state in FIG. 15(*a*) and the back view of the idling state in FIG. 15(*b*).

The air supply-side bore 23 and the fuel supply-side bore 24, as well as the air channel 21 and the mixing channel 22 are proportionally opened during partial horizontal rotation at about 15 to 90°. The air supply-side bore 23 and the fuel supply-side bore 24, as well as the air channel 21 and the mixing channel 22 are proportionally superimposed. The amount of air and the amount of air mixture are increased by the horizontal rotation of the rotor valve 6 in accordance with the superposition angle, as shown by the cross-sectional view of the partial state in FIG. 15(*a*) and the back view of the partial state in FIG. 15(*b*).

The air channel 21 and the air supply-side bore 23 are completely superposed onto each other, the air supply-side bore 23 is fully opened, the fuel supply-side bore 24 and the mixing channel 22 are completely superposed onto each other at the same time, and the fuel supply-side bore 24 is fully opened, as shown by the front view of the fully opened state in FIG. 15(*a*) and the back view of the fully opened state in FIG. 15(*b*).

Thus, when the rotor valve 6 is in an idling state, there is a preceding partial overlap of the mixing channel 22 with the groove pocket 25 in the rotor valve 6, i.e., the groove pocket 25 of the fuel supply-side bore 24 communicates with the mixing channel 22 first, whereby the mixing channel 22 is open but the air channel 21 remains closed. Therefore, all the air and fuel are fed to the engine via the groove pocket 25, causing an emulsion to be formed relatively rapidly and to be fed to the engine. Accordingly, the drop in rotation in the course of a complete change in orientation during idling can be reduced.

The groove pocket is formed symmetrically relative to a center axis at the aperture edge and has a shape that gradually rises and decreases in cross-sectional surface area toward an accelerated rotation direction along the peripheral surface of the rotor valve. Therefore, it is possible to readily control the air-fuel ratio with the aid of a rotor of the same radius even in a smaller fuel supply-side bore.

In addition, forming the rotor valve as a single cylinder makes is possible to design and simple and inexpensive structure without forming differences in grade.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the spirit and scope of the appended claims.

What is claimed is:

1. A rotor for a two-bore rotary carburetor used in a stratified scavenging engine, in which a carburetor main body is provided with a rotor valve fitted into a vertically formed, bottomed cylindrical rotor valve port; the rotor valve is a single cylinder having substantially the same diameter as the rotor valve port; and an air supply-side bore and a fuel supply-side bore are formed through the rotor valve so as to traverse the rotor valve in a radial direction, wherein a minimal groove pocket is formed at a aperture edge of each of the downstream end and upstream end of the rotor valve on the side located in the accelerated rotation direction in the fuel supply-side bore.

2. The rotor for a two-bore rotary carburetor used in a stratified scavenging engine according to claim 1, in which the carburetor main body is provided with the rotor valve fitted into the vertically formed, bottomed cylindrical rotor valve port; the rotor valve is the single cylinder having substantially the same diameter as the rotor valve port; the air supply-side bore having an ascending semicircular shape in cross section and the fuel supply-side bore having a descending semicircular shape in cross section are formed through the rotor valve so as to traverse the rotor valve in a radial direction; a partition is placed between the air supply-side bore and the fuel supply-side bore; and a single common cylindrical circular orifice in which the two are mutually separated is formed, wherein the minimal groove pocket is formed at the aperture edge of each of the downstream end and upstream end of the rotor valve on the side located in the accelerated rotation direction in the fuel supply-side bore.

3. The rotor for a two-bore rotary carburetor used in a stratified scavenging engine according to claim 2, wherein each of the groove pockets is formed at the aperture edge symmetrically relative to a center axis and has a shape that gradually rises and decreases in cross-sectional surface area toward the accelerated rotation direction along a peripheral surface of the rotor valve.

4. The rotor for a two-bore rotary carburetor used in a stratified scavenging engine according to claim 1, in which the carburetor main body is provided with the rotor valve fitted into the vertically formed, bottomed cylindrical rotor valve port; the rotor valve is the single cylinder having substantially the same diameter as the rotor valve port; and the air supply-side bore having a circular shape in cross section and the fuel supply-side bore having a circular shape in cross section are formed through the rotor valve so as to traverse the rotor valve in a radial direction one above the other in a parallel fashion, wherein the minimal groove pocket is formed at the aperture edge of each of the downstream end and upstream end of the rotor valve on the side located in the accelerated rotation direction in the fuel supply-side bore.

5. The rotor for a two-bore rotary carburetor used in a stratified scavenging engine according to claim 4, wherein each of the groove pockets is formed at the aperture edge symmetrically relative to a center axis and has a shape that gradually rises and decreases in cross-sectional surface area toward the accelerated rotation direction along a peripheral surface of the rotor valve.

* * * * *